United States Patent [19]

Gray

[11] Patent Number: 4,720,902

[45] Date of Patent: Jan. 26, 1988

[54] ONE STEP TENSION EXPANDER AND METHOD OF USING

[75] Inventor: Kenneth P. Gray, Syracuse, N.Y.

[73] Assignee: Carrier Corporation, Syracuse, N.Y.

[21] Appl. No.: 944,486

[22] Filed: Dec. 22, 1986

[51] Int. Cl.[4] ..... B21D 53/02

[52] U.S. Cl. ..... 29/157.3 C; 29/157.4; 29/523; 29/727

[58] Field of Search ..... 29/157.4, 157.3 R, 157.3 C, 29/505, 506, 507, 523, 522 R, 33 G, 33 T, 726, 727, 282, 283.5, 464, 466, 467, 445; 72/320

[56] References Cited

U.S. PATENT DOCUMENTS

| | | | |
|---|---|---|---|
| 3,437,133 | 4/1969 | Bullard | 29/157.4 X |
| 4,459,917 | 7/1984 | Michael et al. | 29/157.3 R X |
| 4,519,121 | 5/1985 | Yokosawa | 29/157.3 C |
| 4,543,711 | 10/1985 | Wada et al. | 29/726 |
| 4,584,751 | 4/1986 | Gray et al. | 29/523 X |
| 4,584,765 | 4/1986 | Gray | 29/523 X |

*Primary Examiner*—Howard N. Goldberg
*Assistant Examiner*—Irene Graves Golabi
*Attorney, Agent, or Firm*—Robert H. Kelly

[57] ABSTRACT

A method and apparatus for expanding in compression a portion of a plate fin heat exchanger up to a tube sheet and then gripping the expanded portion of the tube end to expand the remainder of the tube in tension and then unclamping and belling the end of the tube at a single station.

6 Claims, 4 Drawing Figures

ONE STEP TENSION EXPANDER AND METHOD OF USING

BACKGROUND OF THE INVENTION

This invention relates generally to heat exchanger coils and, more particularly, to a method and apparatus for the tension expanding and then belling of plate fin heat exchanger coils.

A plate fin heat exchanger coil is commonly constructed with a plurality of flat, parallel plates having laterally spaced holes therein for receiving refrigerant tubes, or hairpin tubes, therein. At each end of the plate fin bundle there is a tube sheet composed of heavier material, and adjacent one of the tube sheets, the open ends of the hairpin tubes are fluidly connected by way of U-shaped return bends that are secured thereto by way of soldering, brazing, or the like. When the coils are installed into a refrigeration system, the refrigerant is made to flow through the hairpin tubes, and the air to be cooled or heated is made to flow over the plate fins, such that a heat transfer is thereby affected.

As is known, the tube compression expansion process is generally carried out by passing tube expanding rods through the open ends of the hairpin tubes and then belling the tube. A backing plate is placed against the tube bends during compressive expansion to prevent the tubes from being driven out of the unit as the expanding tools are forced therethrough. As a result of this holding action the tubes are compressed rearwardly as they are being expanded outwardly by the tools. This in turn, causes the tubes to shrink so that the axial length of each tube can vary dramatically in final assembly. Because of the differences in tube length, belling of the tubes is difficult and generally results in uneven or misaligned bells being formed in the tube ends. The return bends therefore cannot be properly seated within the bells leading to the formation of relatively weak or incomplete solder joints in this critical region. The uneven bell ends also makes automated brazing or soldering difficult.

In order to better facilitate the formation of the tube bells and the joining of the return bends therein, it has been the common practice in the art to bring the open ends of the hairpins a considerable distance out from the adjacent tube sheet. The additional length of tube allows each bell to be brought to full depth without interference from the tube sheet and also permits the return bend joint to be brazed or soldered. The unsupported length of tube between the bell and the tube sheet, however, represents the weakest section in the unit. Hydrostatic tests have shown that the flow circuit will generally rupture in this region when exposed to high internal stresses. Beyond weakening the unit the added length of tubing wastes costly material and thus raises the cost of each unit. Furthermore, the added tube length makes it difficult to compact the unit which in the case of a room air conditioner is of primary importance.

In order to improve the hydrostatic burst strength of a plate fin heat exchanger, a technique for tension expanding hairpin tubes into a fin pack unit, as explained in greater detail in U.S. Pat. No. 4,584,765 was developed. This prior technique was generally carried out on a three row coil which was first belled by a split collet and pin arrangement, and then expanded. Because of the closeness of the heat exchanger tube rows the bells that were formed are simple, single diameter bells, to which pre-tinned return bends are nested. Further, because of the closeness of the heat exchanger tube rows, the jaw members of the tube clamping fixture were relatively long, thin members. In operation, however, these long, thin jaw members bowed during the expansion process. Furthermore, the single diameter bell was not suitable for ultrasonic soldering, but had to use pretinned return bends. Thus, to use ultrasonic soldering, the bell diameter would have had to be increased, which would have required even less space between adjacent tubes, making the jaw member even thinner and subject to more bowing in the horizontal direction.

A disadvantage of the prior tension expansion process is that a heat exchanger unit is first belled at one station, and then the belled unit must be conveyed and indexed into another station to be expanded. As a consequence, the manufacture of the plate fin heat exchanger is time consuming and costly.

A further disadvantage of the prior expansion process is that it is limited to coils having a fixed row to row dimension.

Thus, there is a clear need for a simple tension expansion and belling apparatus which eliminates the need for belling a coil at one station and then moving the belled coil to another station for expansion and also which can expand coils having different, tow to row dimensions.

SUMMARY OF THE INVENTION

It is an object of the present invention to simplify the manufacture of plate fin heat exchangers.

It is another object of the present invention to reduce the manufacturing cost of a plate fin heat exchanger.

It is a further object of the present invention to tension expand and bell plate fin heat exchanger coils at one station.

It is still another object of the present invention to provide a safe, economical and reliable method of expanding then belling a coil and an apparatus for expanding and belling a plate fin heat exchanger at one station.

It is still a further object of the present invention to expand and bell a coil having different row to row dimensions.

These and other objects of the present invention are attained by a method of tension expanding and then belling a plate fin coil at a single station during the manufacturing process. The method includes expanding the coil for a short distance using compression expansion, clamping the fin pack and expanding the remainder of the coil using tension expansion, unclamping the fin pack and sliding the belling tool over the expanded rods to bell the ends of the coil.

An expander/beller is further disclosed including a receiver for supporting the hairpin end, an expander having a bullet on the end of a rod, actuating means for inserting the expander into the coil a short distance beyond the tube sheet and expanding the coil in compression expansion for said short distance, clamping means for gripping the ends of the tubes of the coil, the actuating means further inserting the expander into the coil to expand the coil in tension expansion, and a belling means slidable over the expander rod after the clamping means in unclamped from the ends of the tubes to bell the ends of the tubes.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
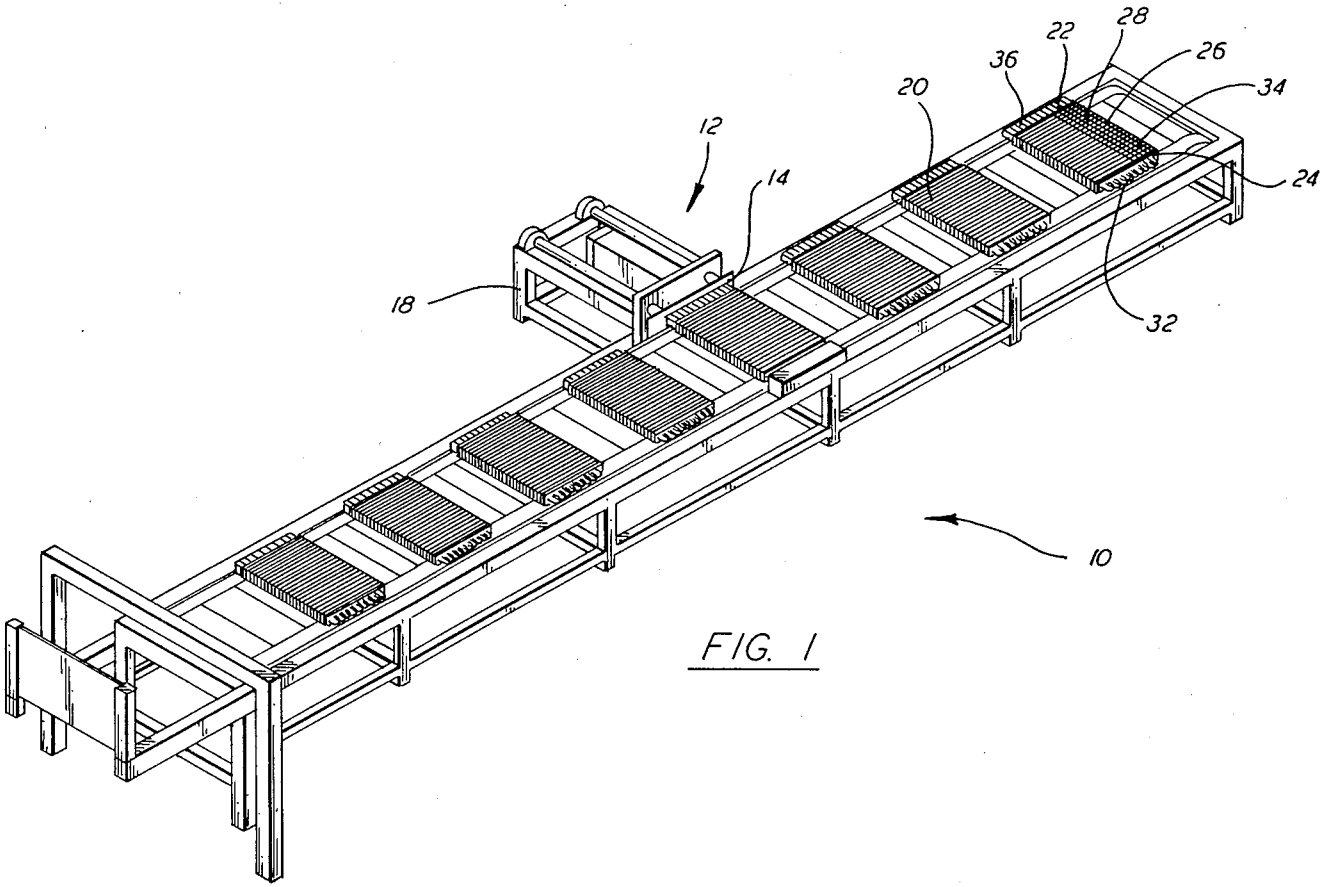
FIG. 1 is a perspective view of a portion of a plate fin coil assembly apparatus embodying the teachings of the present invention.

Referring now to FIG. 1, there is shown a portion of a plate fin heat exchanger assembly system 10 with the various components used in accordance with the method and apparatus of the present invention. The present plate fin coil manufacturing apparatus is described in connection with a single combination expander/beller station 12. Prior to arriving at the expander/-beller station 12, the plate fin heat exchangers 20 are partially assembled at a lacing station (not shown). As may be seen from the various figures, the plate fin heat exchanger 20 has a plurality of fins 26, a bottom tube sheet 24, and a top tube sheet 22. Hairpin tubes 28 are arranged having a bend end portion 32 and leg portions 34 such that the leg portions extend through the entire fin bundle and tube sheet 24 to tube sheet 22 and then extend beyond tube sheet 22 defining extension portions 36. The hairpin tubes are physically inserted or laced through arranged openings in the fins and tube sheets into the positions as shown.

The tube expander/beller station 12 includes a plurality of hydraulically actuated tools 14 for expanding and belling tubes in one operation that are mounted on a support platform 18. The platform functions to index the plate fin heat exchanger within the expander/beller station so that the open ends of the hairpin tubes are in alignment with the tools 14. As shown in this particular embodiment, the plate fin heat exchangers are single row coils, but the coils may be multirow coils. Further, the expander/beller station 12 includes a receiver means 38 which push the hairpin tubes 28 toward the tools 14 during the compression portion of the expansion/belling operation. The receiver means 38 further insure that all the tube ends will be even if there are length differences in the hairpin tubes 28. Further, the tools 14 include a plurality of hydraulically operated clamp means, and bullet rods coacting with beller tools slidable thereon. In FIG. 1 the tools 14 as described further hereinafter are shown in the fully expanded and belled position.

Figure 2:
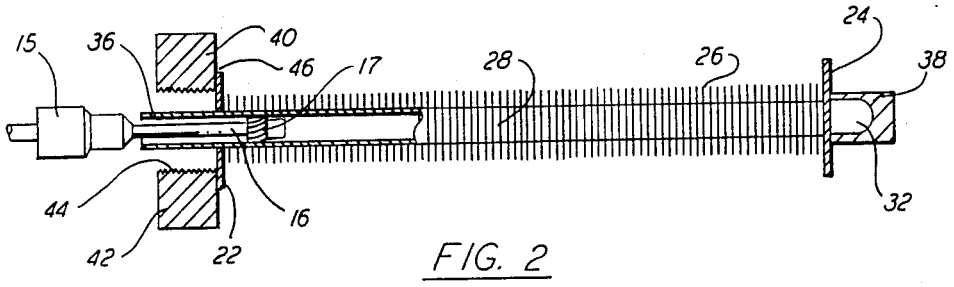
FIG. 2 is an enlarged side elevation view partly broken away showing one of the expanding rods used in the present invention during the compression expansion stroke.
Figure 3:
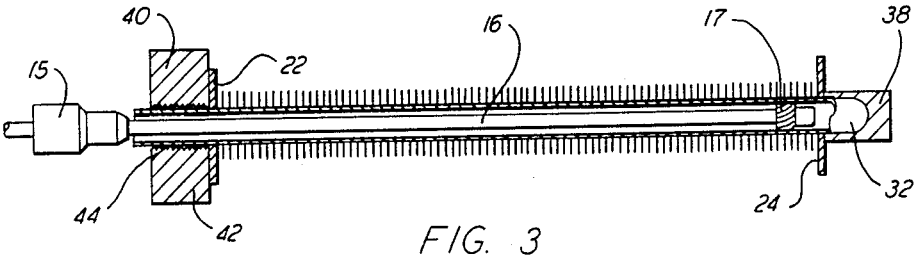
FIG. 3 is an enlarged side elevation view partly broken away showing the expanding rod of FIG. 2 after it has fully expanded the tube in tension expansion.
Figure 4:
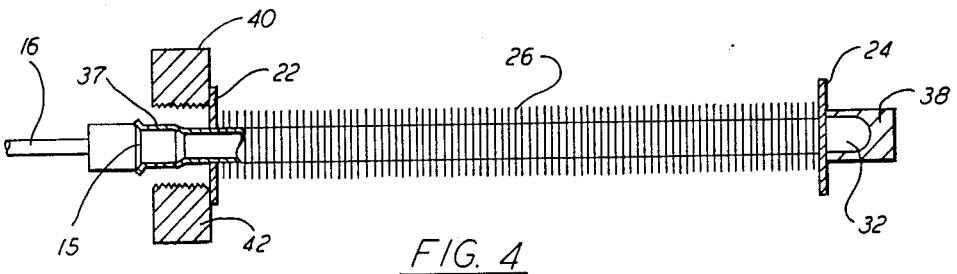
FIG. 4 is an enlarged side elevation view partly broken away showing the belling tool after forming the bell in the end of the tube.

Turning now to FIGS. 2–4 there is shown a single tube of the plate fin heat exchanger 20 during the expanding and belling operation of the present invention. The tube is held within the expander/beller station 12 by means of axially movable receiver means 38 which is adapted to act against the bend end portion 32 of the tube and movable clamp means 40 which may include for example a pair of movable jaw members 42 with serrated teeth 44, which move in and out of contact with the tube, which acts against the top tube sheet 22. In this particular embodiment, the tools 14 include a bullet rod 16 having an expansion bullet 17 mounted on the end of the bullet rod and having an outside diameter greater than the inside diameter of the tube, and a beller tool 15 slidable on the bullet rod 16 such that when the expansion bullet has traversed the full length of the interior of the tube the beller tool is actuated, for example by a known hydraulic system similar to the system for actuating the bullet rod, to provide the appropriate bell portion 37.

In operation, with the partially assembled plate fin heat exchanger 20 indexed within the expander/beller station 12, the receiver means 38 is moved, by conventional means such as a hydraulic piston, against the bend end portion 32 of the hairpin tube 28 so that the top tube sheet 22 is in contact with the back wall of the clamp means 40. With the jaw members 42 open the bullet rod 16 is moved to drive the expansion bullet 17 through the extension portion 36 to deform the tube into the top tube sheet 22 by compression expansion. The clamp means 40 is then actuated to close the jaw members 42 around a portion of the expanded portion of the tube to secure the tube against movement as the remainder of the tube is expanded in tension expansion. With the tube fully expanded the jaw members 42 are released from the tube and the beller tool 15 is then actuated to slide along the bullet rod 16 so that the extension portion 36 is belled in compression belling and the bell engages the top tube sheet 22 to improve the hydrostatic burst strength of the plate fin heat exchanger 20.

While a preferred embodiment of the present invention has been depicted and described, it will be appreciated by those skilled in the art that many modifications, substitutions, and changes may be made thereto without departing from the true spirit and scope of the invention.

What is claimed is:

1. A method of tension expanding and then belling a partially assembled plate fin heat exchanger having a plurality of apertured plate fins parallelly spaced between two apertured tube sheets and a plurality of hairpin tubes extending through the apertures wherein the open ends of the tubes are positioned for the tension expansion and belling operation at a single manufacturing station, comprising the steps of:

locating the partially assembled plate fin heat exchanger in the single station so that a tube sheet proximate the open end of the tubes is adjacent a combination expanding and belling tool of the single station whereby the open end of the tubes are axially aligned with a row of tubes;

acting on a bend end of the hairpin tubes with a receiver means which matingly engages the bend end to bias the tube sheet proximate the open end of the tubes toward the expanding and belling tool so that a desired length of the tube extends beyond the proximate tube sheet:

expanding the walls of the hairpin tubes outwardly into contact with generally only the desired length of the tube extending beyond the proximate tube sheet and the tube sheet proximate the open end of the tubes with the expanding tool while the bend end is biased:

clamping the expanded walls of the hairpin tubes in a clamp means to prevent the hairpin tubes from moving while removing the receiver means from contact with said bend end and tension expanding the remainder of the hairpin tubes to lock the tubes against the fins and remaining tube sheet; and unclamping the expanded walls of the hairpin tubes while again acting on a bend end with the receiver means and driving the belling tool into the open ends of the tubes to form radially expanded bells.

2. The invention as set forth in claim 1 wherein the belling tool driving step includes sliding the belling tool along a bullet rod having the expanding tool attached thereto.

3. The invention as set forth in claim 1 wherein the steps of acting on a bend end, expanding the walls, clamping the expanded walls and expanding the remainder of the hairpin, and unclamping the expanded walls and driving a belling tool are performed sequentially on adjacent single rows of a multirow heat exchanger.

4. An aparatus for partially expanding in compression the hairpin tubes of a plate fin heat exchanger having a plurality of apertured plate fins parallelly spaced between two apertured tube sheets and the tubes extending through the apertures and then completing the expansion of the tubes in tension and then belling the tubes at a single operating station comprising:

receiver means for engaging bend ends of the hairpin tubes, said receiver means being arranged to bias the hairpin tubes a desired length through a tube sheet proximate the open ends of the hairpin tubes:

expander means having an expander rod with an expander bullet arranged to pass through an axially aligned tube to expand the tube through said desired length in compression expansion;

clamping means for clamping the expanded tube along said desired length previously expanded, whereby said expander means completes expanding the tube its entire length in tension expansion, and beller means movably mounted on said expander rod for belling said desired length in compression.

5. The apparatus as set forth in claim 4 wherein said clamping means includes a pair of jaw members for frictionally engaging the tube at said desired length.

6. The apparatus as set forth in claim 5 wherein each of said jaw members includes serrated teeth for engagement with the tube.

* * * * *